United States Patent [19]

Bricmont

[11] Patent Number: 4,629,422

[45] Date of Patent: Dec. 16, 1986

[54] FRAME APPARATUS FOR SUPPORTING WORKPIECES IN A REHEAT FURNACE

[75] Inventor: Francis H. Bricmont, Pittsburgh, Pa.

[73] Assignee: Bricmont & Associates, Inc., McMurray, Pa.

[21] Appl. No.: 778,628

[22] Filed: Sep. 23, 1985

[51] Int. Cl.[4] ..... F27D 3/02

[52] U.S. Cl. ..... 432/234

[58] Field of Search ..... 432/234

[56] References Cited

U.S. PATENT DOCUMENTS 2,482,878 9/1949 Schmidt ..... 432/234

3,716,222 2/1973 Anderson ..... 432/234

*Primary Examiner*—John J. Camby

*Attorney, Agent, or Firm*—Thomas H. Murray; Clifford A. Poff

[57] ABSTRACT

Spaced-apart skid frames support workpieces in a reheat furnace. Each skid frame includes a plurality of spaced-apart rails arranged to extend along the path of travel of the workpieces in the furnace for engaging the underside faces of the workpieces. A tubular top cord member carries rail members. Two horizontally-spaced tubular lower cord members extend parallel and below the top cord member. Tubular web members extend angularly between joints which intersect with the top and lower cord members to form a lattice structure having triangular open spaces between the top cord member in each of the lower cord members for passage or radiation to heat the underside faces of workpieces along either side of the skid frames. Coolant is supplied to each of the top and lower cord members and the tubular web members to prevent overheating.

15 Claims, 7 Drawing Figures

FRAME APPARATUS FOR SUPPORTING WORKPIECES IN A REHEAT FURNACE

BACKGROUND OF THE INVENTION

This invention relates to a support apparatus for workpieces while advancing along a reheat furnace; and more particularly, to such an apparatus having an upper and at least one, but preferably two, lower cord members interconnected by tubular web members, all of which are water-cooled and form triangular open spaces for the passage of heat radiation to the underside faces of workpieces to eliminate or at least minimize skid marks.

As is known in the art, water-cooled skids or beams are used to support metallic workpieces in a furnace during heating to a desired temperature. Workpieces, such as billets, blooms or slabs, can be heated to a desired temperature for processing in a rolling mill in a continuous pusher-type furnace or in a walking-beam type furnace. In a pusher-type furnace, a cold workpiece is transported to the charging end where pushers are operated to advance the workpiece against a continuous stream of workpieces into the furnace. When a cold workpiece is advanced into the furnace, a heated workpiece passes through a discharge door at the opposite end of the furnace. In a walking-beam type furnace, workpieces are advanced in the furnace chamber with step-by-step movements by walking-beam assemblies that form stationary and movable supports for the workpieces. The movable supports first lift the workpiece from the stationary support. The movable support is then advanced toward the exit end of the furnace through a predetermined distance, lowered onto the stationary supports. Thereafter, the movable support is retracted for the next cycle of operation. One form of construction of the movable and stationary supports for a walking-beam type furnace can be found in my U.S. Pat. No. 4,290,752.

In a pusher-type furnace and, to a lesser extent, in a walking-beam type furnace, variations to the elevated temperature of the workpiece occur at the site where the workpiece is in contact with a support member while exposed to the high-temperature environment in the furnace. In a continuous slab reheat furnace, for example, the slabs are progressively advanced forwardly toward the discharge end of the furnace on water-cooled skids. Burners are located above and below the skid level and furnish heat by radiation and convection to both the top and bottom surfaces of the slabs while the slabs reside in the heating zones and, depending upon the furnace construction, a preheating zone. The water-cooled skids normally terminate at the entrance to a soaking zone where the slabs are supported on a continuous refractory hearth. In the soaking zone, only top burners are provided since the slabs arrive at the soaking zone at approximately the desired rolling temperature.

In the soaking zone, principle heat requirements for the slab are met. In this zone, skid marks which are visible and essentially are cooler, strip-like areas extending across the slabs due to contact with the water-cooled skids, must be eliminated, if possible, as well as other temperature non-uniformities while maintaining the desired furnace temperature to compensate for radiation losses. However, it has been found that even after a slab is treated in the soaking zone, there still remains a temperature differential between the sites of the skid marks and the remaining part of the slab. Direct radiation heating of the skid mark sites is not possible because the face surface of the slab containing the skid marks is in continuous contact with the hearth.

As is known in the art, water-cooled skid pipes for a pusher-type reheat furnace generally take the form of spaced-apart and generally parallel pipes extending in the direction of slab movement. The skid pipes are anchored at the charging end of the furnace and terminate at a furnace wall where the pipes are connected to water supply lines. Wear bars are welded or otherwise secured to the top surface of the skid pipes. The skid pipes are usually provided with a covering of heat insulating-material. Extending transversely to the water-cooled skid pipes are other pipes which are supported by the walls of the furnace as well as, in some instances, by downwardly-extending props which are also pipes. The transversely-arranged pipes are spaced apart at intervals so as to provide sufficient support for the length of the water-cooled skid pipes. The transversely-arranged support pipes are also provided with outer coverings of heat-insulating material and they are continuously fed with a water for cooling. Various forms of water-cooled skid pipes are shown, for example, in U.S. Pat. Nos. 2,482,878; 3,236,507; 3,311,357; 3,345,050; 3,706,448; 3,804,584 and 4,056,351.

Conventional well-known skid pipes drain substantial amounts of heat from the furnace due to the requirement for a continuous flow of cooling water in the skid pipes as well as the transversely-extending pipes on which the skid pipes are supported. The skid pipes are relatively large, for example, the pipe may have a five-inch outside diameter with a one-inch wall thickness on which an outer layer of heat insulation is applied, whereby the resulting skid structure necessarily immediately adjacent the undersurface of the slab, masks a large area of the slab from heat radiation. In other words, the ultimate size of the water-cooled skid pipe structure is sufficiently large and in close proximity to the downwardly-directed surfaces of the slab so that not only is the actual area of contact between the skid pipe and the slab obscured from impingement with heat radiation but also presents a poor radiant shaped factor that isolates or shadows areas immediately adjacent either side of the skid rail from heat radiation. The size of the skid pipe is selected, of course, to withstand loading imposed by the workpieces. The loading of the skid pipe includes not only the weight of the workpieces but also large stresses occurring transversely to the extended length of the skid pipes due to expansion of the workpieces during the heating process. Transverse loading of the skid pipes is a significant factor that must be dealt with in pusher-type furnaces. In walking-beam type heating furnaces, transverse loading of the workpiece-support member occurs to a lesser extent because the workpieces are intermittently contacted by the walking-beam mechanism.

SUMMARY OF THE INVENTION

It is an object of the present invention to provide an apparatus for supporting workpieces in a furnace during advancement of the workpieces in which the apparatus embodies a construction of parts which maximizes the amount of radiation as well as the transfer of heat to the underside of the workpiece, particularly at sites closely adjacent the contact area between the workpiece and the apparatus.

It is a further object of the present invention to provide a support system for workpieces undergoing heating in a furnace which minimizes the mass of the load bearing structure adjacent the area of supporting contact with the workpieces and, at the same time, minimizes the requirement for a supporting foundation to carry the support system and to avoid a loss of heat due to circulating coolant.

It is a still further object of the present invention to provide a system for supporting workpieces, particularly slabs in a pusher-type slab-heating furnace which will virtually eliminate skid marks by providing a construction for support structure wherein a major part of the mass of the structure is remote to the support site for the workpieces while at the same time lateral rigidity of the support structure is dramatically increased to accommodate expansion of the workpieces during the heating process.

Another object of the present invention is to provide a support structure for workpieces undergoing heating in a furnace in which the structure includes diverse members held in a spaced-apart relation at different elevations while extending in the direction of movement of the workpieces so that a major part of the mass of the structure is remotely spaced from the workpiece, thereby improving the exposure of the work-piece to incident heat radiation.

More particularly, according to the present invention, there is provided a frame apparatus for supporting workpieces in a reheat furnace having walls adapted to radiate heat to workpieces, the frame apparatus including the combination of rail means extending along the path of travel of the workpieces in the furnace for engaging the underside faces of the workpieces, a tubular top cord member for carrying the rail means, at least one tubular lower cord member generally parallel and spaced below said tubular top cord member, tubular web members extending angularly between joints which intersect with said top and lower cord members to form a lattice structure having triangular open spaces for passage of radiation to heat the underside faces of workpieces along either side of the rail means, and supply means for coolant coupled to each of the top and lower cord members and the tubular web members.

The frame apparatus of the present invention preferably includes two horizontally, spaced-apart tubular lower cord members that are generally parallel and spaced below the top cord member. All three tubular cord members are joined together by tubular web members to form the open lattice structure characterized by the triangular open spaces between all of the cord members. The tubular web members preferably comprise bent lattice tubes having a serpentine configuration to extend back and forth between joints at the points of intersection with each cord member. The joints are preferably defined by weld sites and may include saddle members to join lattice tube to a cord member. Heat insulation is applied to the cord members as well as the tubular web members.

These features and advantages of the present invention as well as others will be more fully understood when the following description is read in light of the accompanying drawings, in which.

Figure 1:
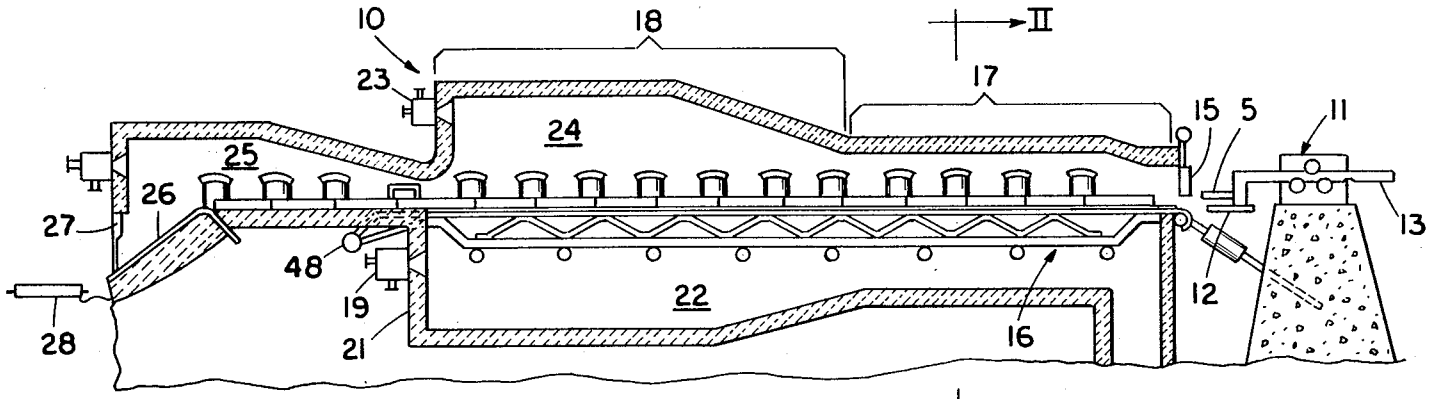
FIG. 1 is an elevational view, in section, illustrating a pusher-type slab reheat furnace including slab-support members embodying the features of the present invention.
Figure 2:
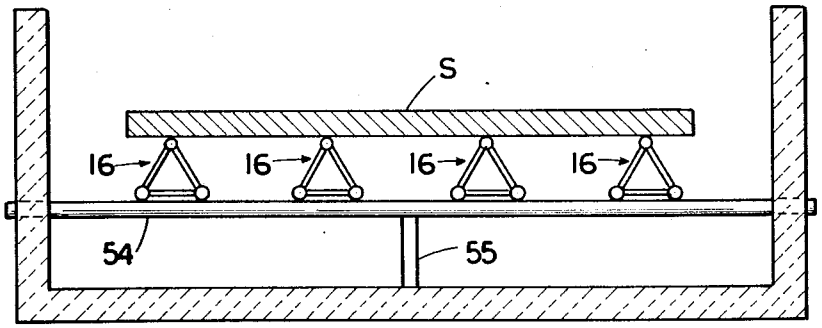
FIG. 2 is a sectional view taken along line II—II of FIG. 1.

In FIG. 1, reference numeral 10 identifies a continuous slab-type reheat furnace having a slab pusher 11 at the entry side of the furnace to engage with a longitudinal side edge of a slab S. A furnace entry table 12 delivers a succession of slabs to the entry side of the furnace where a ram 13 of the slab pusher 11 advances slabs through a door opening in the furnace. The door opening is normally closed by a door 15. A newly-charged slab is moved into an abutting relation against a slab previously introduced into the furnace. Continued movement of the pusher advances all the slabs in a direction toward the discharge end of the furnace. The skid frames extend along a preheat zone 17 and a heating zone 18. A burner 19 is supported by a bottom burner wall 21 to generate a high-temperature environment in a flue space 22 which extends along the furnace beneath the slabs in preheat zone 17 and heating zone 18. A burner 23 communicates with a flue space 24 above the slabs to create a high-temperature-environment for heating the slabs from their top surfaces.

Beyond the heating zone 18, there is a soaking zone 25 having a refractory hearth which extends from the bottom burner wall 21 to downwardly-inclined skids 26 used to direct a heated slab from the furnace through a door opening 27 onto a furnace delivery table 28. Other forms of workpiece delivery systems known in the art can be used where a slab is carried from the soaking zone by mechanical extractor arms through a door opening onto a furnace delivery table.

The skid frames of the present invention shown in FIGS. 2–5 each includes wear bars 40 arranged in a spaced-apart and end-to-end relation to present skid surfaces 41 for engaging the undersurfaces of slabs during passage along zones 17 and 18 of the furnace. The wear bars have annular bottom surfaces 41A which engage a tubular top cord member 42 and attached thereto by suitable means such as weld metal extending along a side edge of each wear bar. By way of comparison, for example, the top cord member 42 can take the form of a metal pipe having an outside diameter that is less than half the outside diameter of conventional water-cooled skid pipes, thereby greatly increasing the area at the underside of the slab which is exposed to heat radiation. This, in turn, enhances conductive heating of the undersurface of the slab so that the area of the slab in contact with the skids can be heated to a temperature which is about 125 to 150 degrees Fahrenheit hotter than presently attainable when using conventional water-cooled skids.

Figure 3:
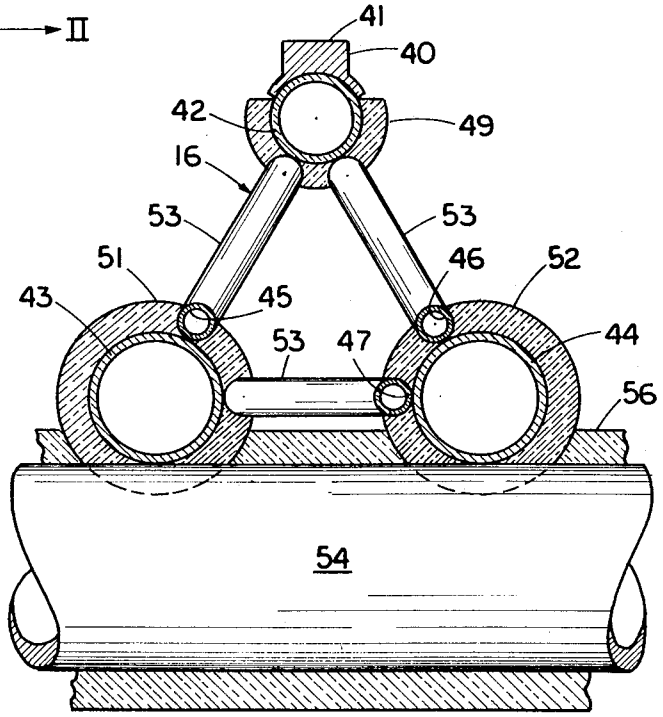
FIG. 3 is an enlarged view of one skid frame according to one embodiment of the present invention shown in FIG. 2.
Figure 4:
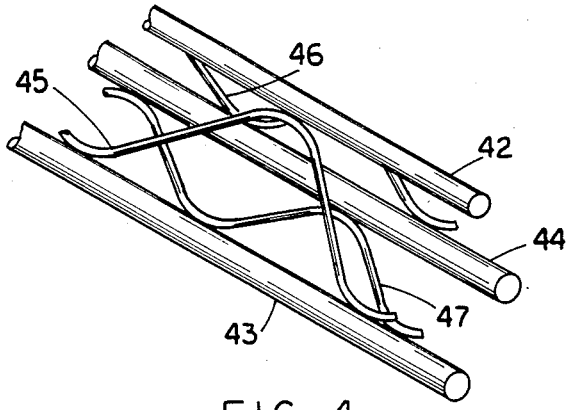
FIG. 4 is an isometric view of the skid frame shown in FIG. 3 with heat insulation removed.
Figure 5:
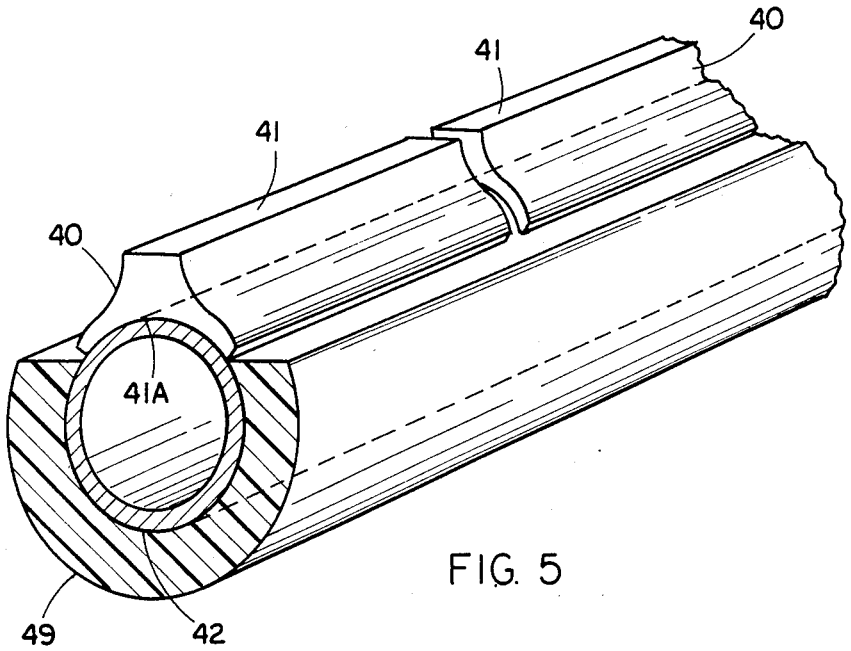
FIG. 5 is an enlarged isometric view of the top cord member of the skid frame shown in FIG. 3.

Spaced below the top cord member is at least one, but preferably two, spaced-apart and generally parallel lower cord members 43 and 44 preferably in the form of tubes whose outside diameter is preferably slightly greater than the outside diameter of the top cord member. The top cord member and the lower cord members are connected together, one with the other, by tubular web members 45, 46 and 47. Web members 45 and 46 extend in an angularly and continuous manner between joints which intersect with the top cord member and the lower cord members 43 and 44, respectively. Web member 47 extends angularly and continuously between joints which intersect with the two lower cord members 43 and 44. The web members 45–47 form a lattice structure having triangularly-shaped open spaces to enhance the passage of radiation for impingement with the underside faces of workpieces while supported by the skid frames. Cord members 42–44 as well as web members 45–47 are coupled to supply pipes 48 for delivering collant water for protecting the metallic members against the adverse high-temperature environment in the furnace. The top cord member is provided with an annular layer of heat-insulating material 49 along an exposed surface of the member. As shown in FIGS. 3 and 5, the heat-insulating material 49 wraps about the outer surface of the cord member 42 to a point of abutment with diverging leg portions of the skid bars. The lower cord members are provided with outer layers of heat insulation 51 and 52 and web members 45–47 are provided with an outer layer of heat insulation identified by reference numeral 53. The lower cord members 43 and 44 are supported by pipes 54 which extend at spaced-apart locations transversely of the furnace with respect to the direction of travel by workpieces along the furnace. The pipes 54 extend in a known fashion between side walls of the furnace and may be supported by post members 55. The pipes 54 are coupled to a supply of collant water and they are also provided with an outer layer of heat insulation 56 to minimize heat loss due to the flow of collant water.

Figure 6:
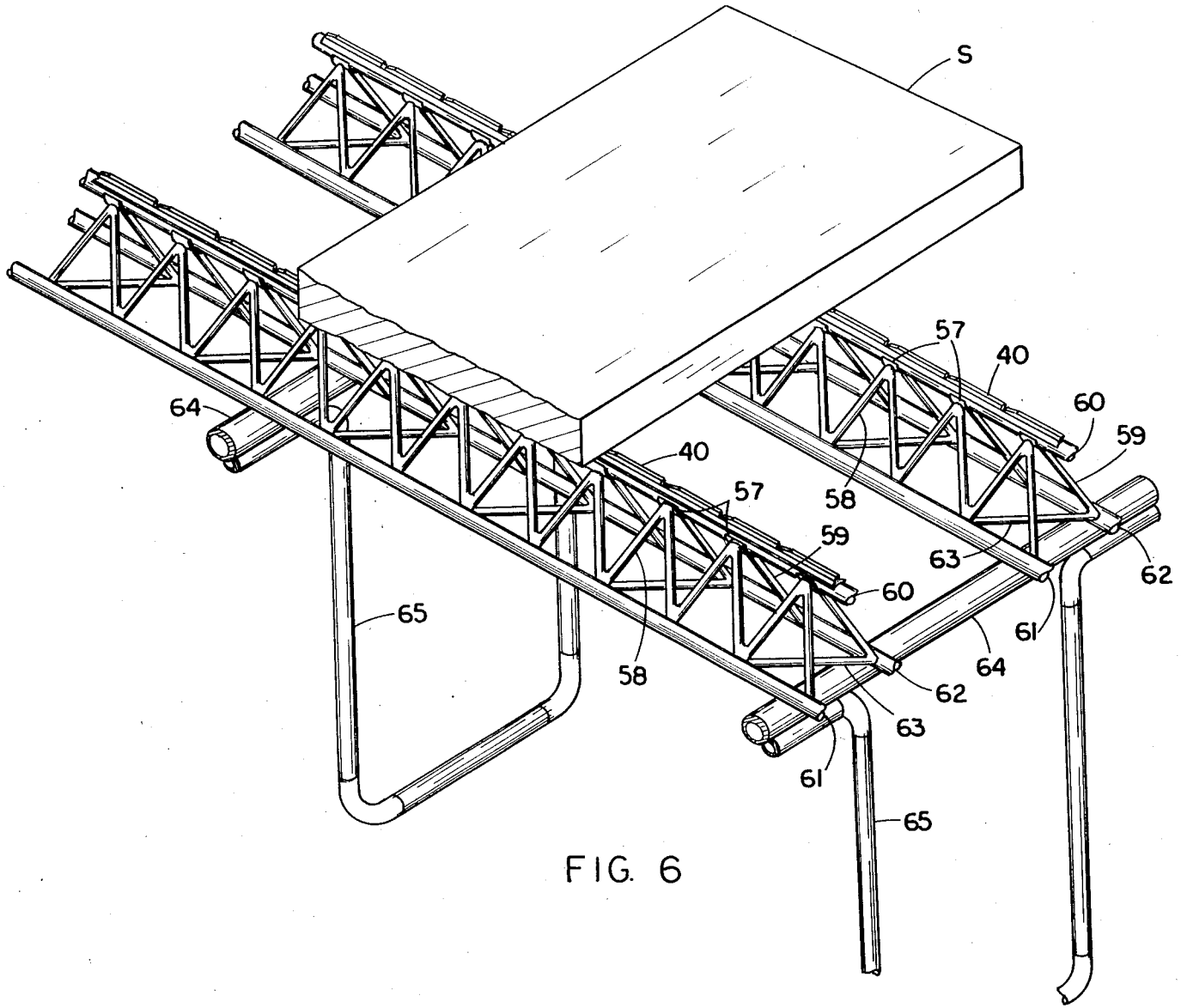
FIG. 6 is an isometric view of skid frames according to a second and preferred embodiment.

In FIG. 6, there is illustrated a preferred embodiment of the skid frames of the present invention which differs from the embodiment described hereinbefore by the provision of saddle plates 57 which form the joints interconnecting web members 58 and 59 with the top cord member 60. The saddle members are welded to the web members and, in turn, the saddle members are connected as by weld metal to the top cord member. In FIG. 6, the covering of insulation extending along the top cord member has been omitted for clarity. It is to be understood that saddle members can also be used to form the points of intersection between the web members 58 and 59 and each of lower cord members 61 and 62. Web member 63 will be joined to the saddle members of lower cord members 61 and 62. The use of saddle members facilitates fabrication of the skid frames. In the embodiment of FIG. 6, support pipes 64 engage with a brace 65 in the form of a bent metal pipe which is arranged so that a vertical leg section extends between the support pipe and a horizontal leg section at the site of each skid frame. The number of support pipes 64 which are necessary to support the skid frames can be greatly reduced because of the construction of the skid frames. This minimizes heat loss because the amount of collant which passes through the heating zone of the furnace is correspondingly reduced, whereby less fuel is needed to maintain a high temperature in the chamber below the workpieces.

Figure 7:
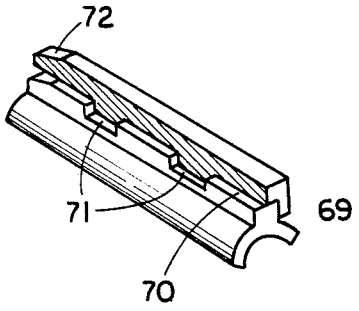
FIG. 7 is an isometric view of a modified form of skid rail.

In FIG. 7, there is illustrated a modified form of the construction of the skid rail 69. As shown, the top surface 70 of the skid rail has spaced-apart, transverse slots 71 which can interfit with lugs that extend from the inside surface of a rail attachment 72. The rail attachment has a generally U-shaped cross-sectional configuration forming leg sections that extend along opposite lateral sides of the rail. The attachment can be made of cobalt or other material selected for wear and high-heat conductivity. The interfitting lug construction between the wear insert and the rail prevents dislodgement of the insert from the rail during passage of a workpiece along the skid frames.

Although the invention has been shown in connection with certain specific embodiments, it will be readily apparent to those skilled in the art that various changes in form and arrangement of parts may be made to suit requirements without departing from the spirit and scope of the invention.

I claim as my invention:

1. A frame apparatus for supporting workpieces in a reheat furnace having walls adapted to radiate heat to workpieces, said frame apparatus including the combination of:

rail means extending along the path of travel of the workpieces in the furnace for engaging the underside faces of the workpieces, a tubular top cord member for carrying said rail means, a plurality of tubular lower cord members generally parallel and spaced below said tubular top cord member, tubular web members extending angularly between joints which intersect with said top and lower cord members to form a lattice structure having triangular open spaces for passage of radiation to heat the underside faces of workpieces along either side of said rail means, and means for supplying coolant to said top and lower cord members and said tubular web members.

2. The frame apparatus according to claim 1 wherein said tubular web members include bent lattice tubes with a serpentine configuration extending back and forth between said joints.

3. The frame apparatus according to claim 2 wherein said intersection joints comprise weld sites.

4. The frame apparatus according to claim 1 further including heat insulation on each of said top and lower cord members and said tubular web members.

5. The frame apparatus according to claim 1 wherein said rail means include wear bars extending longitudinally along said tubular top cord member.

6. The frame apparatus according to claim 1 wherein said top and lower cord members comprise metal tubes.

7. The frame apparatus according to claim 1 further including saddle members forming said joints which intersect with at least one of said cord members.

8. A frame apparatus to support workpieces in a reheat furnace having walls adapted to radiate heat to workpieces, said frame apparatus including the combination of:

a plurality of spaced-apart rail means extending along the path of travel of the workpieces in the furnace for engaging the underside faces of the workpieces, a tubular top cord member for carrying each of said rail means, two horizontally, spaced-apart tubular lower cord members generally parallel and spaced below said tubular top cord member for each of said rail means, tubular web members extending angularly between joints which intersect with said top and lower cord members to form a lattice structure having triangular open spaces between said top cord member and each of said lower cord members for passage of radiation to heat the underside faces of workpieces along either side of said rail means, and supply means for coolant coupled to each of said top and lower cord members and said tubular web members.

9. The frame apparatus according to claim 8 wherein said tubular web members include bent lattice tubes with a serpentine configuration extending back and forth between said joints.

10. The frame apparatus according to claim 9 wherein said joints comprise weld sites.

11. The frame apparatus according to claim 8 further including heat insulation on each of said top and lower cord members and said tubular web members.

12. The frame apparatus according to claim 8 wherein said rail means include a wear bar extending longitudinally along each of the tubular top cord members.

13. The frame apparatus according to claim 8 wherein said top and lower cord members comprise metal tubes.

14. The frame apparatus according to claim 13 wherein said metal tubes have annular walls.

15. The frame apparatus according to claim 8 further including saddle members forming said joints which intersect with said top and lower cord members.

* * * * *